United States Patent [19]

Kinghorn, Sr. et al.

[11] 4,273,250

[45] Jun. 16, 1981

[54] SEALING SYSTEM FOR LIQUID STORAGE TANKS

[76] Inventors: Mark D. Kinghorn, Sr., 1333 Rte. 30, Schererville, Ind. 46375; Mark D. Kinghorn, Jr., 8044 Howard, Munster, Ind. 46321

[21] Appl. No.: 33,697

[22] Filed: Apr. 26, 1979

Related U.S. Application Data

[63] Continuation of Ser. No. 873,218, Jan. 30, 1978, abandoned.

[51] Int. Cl.[3] ..... H05B 1/00; A45D 1/04

[52] U.S. Cl. ..... 220/220; 220/222; 220/226

[58] Field of Search ..... 220/221, 222, 224, 225, 220/226, 216, 220

[56] References Cited

U.S. PATENT DOCUMENTS

| | | | |
|---|---|---|---|
| 2,897,998 | 8/1959 | Ulm | 220/224 |
| 3,373,891 | 3/1968 | Kidd | 220/222 |
| 3,583,594 | 6/1971 | Belanger et al. | 220/222 |
| 4,099,644 | 7/1978 | Nuttall et al. | 220/222 X |

FOREIGN PATENT DOCUMENTS

| | | | |
|---|---|---|---|
| 254342 | 9/1964 | Australia | 220/226 |

*Primary Examiner*—Joseph Man-Fu Moy
*Attorney, Agent, or Firm*—August E. Roehrig, Jr.

[57] ABSTRACT

A sealing system for a liquid storage tank having a roof freely floating on the contents stored within the storage tank. The sealing system is in wiping contact with the tank shell and may utilize a primary and a secondary seal. As a primary seal, the system forms a seal above the liquid level and eliminates capillary action of the liquid between the seal and the tank shell. The sealing system also exerts a continuous pressure against the inner walls of the storage tank preventing the storage tank roof from shifting due to wind loading and effectively preventing vaporization of the liquid due to wind effected negative pressures. As a secondary seal, the system acts as a vapor barrier preventing vapors from escaping and preventing contaminants from entering into contact and deteriorating the primary seal which could result in contamination of the liquid contained within the storage tank.

11 Claims, 9 Drawing Figures

SEALING SYSTEM FOR LIQUID STORAGE TANKS

This is a continuation of application Ser. No. 873,218, filed Jan. 30, 1978, now abandoned.

BACKGROUND OF THE INVENTION

This invention relates in general to sealing systems for liquid storage tanks and, in particular, to a seal system for preserving the integrity of liquid contained in a storage container or tank having a roof freely floating on the contents contained within the storage tank.

More specifically, but without restriction to the particular use which is shown and described, this invention relates to a sealing system for a liquid storage tank having a roof freely floating on the contents contained within the tank and includes a sealing system which is adapted to function as a primary and secondary seal to prevent contamination of the stored liquid and to minimize or eliminate evaporation loss.

When storing liquids in large containers or storage tanks of the type having a roof freely floating on the contents contained in the tank, it is necessary in order to prevent contamination of the stored liquid by rain, snow, dust, dirt and the like to effect a seal between the floating roof and the inner walls of the tank shell to prevent these contaminants from entering into the tank and thereby contaminating the liquid contents. In addition, it is both desirable and necessary to prevent loss of the stored liquid through evaporation. Such evaporation losses due to vaporization are not only costly due to loss of the stored liquid, but are frequently required to be controlled due to governmental pollution agencies' regulations that require the storage tanks to meet specific emission control or vapor loss standards. Therefore, such storage tank sealing systems should be capable of preventing contaminant material from entering the storage tank and be effective to minimize or effectively eliminate evaporation losses.

In order to meet these preferred requirements, the sealing systems for storage tanks should conform to any distortions or irregularities in the inner walls of the storage tank shell. In addition, it is desirable that an adequate outward thrust be applied by the seal against the tank shell to minimize or eliminate gaps between the seal and the internal shell walls and to prevent shifting of the floating roof due to wind loads.

Many and various approaches have been taken in an attempt to provide such a sealing system, such as, for example, the structures disclosed in U.S. Pat. No. 3,589,549 and U.S. Pat. No. 3,373,891. However, with sealing systems utilizing both a primary and a secondary seal, in order to inspect the primary seal to insure that it is still effective and does not require repair, it is desirable to have easy access to the primary seal without requiring that the seal or associated structure be removed. In such sealing systems utilizing both a primary and a secondary seal, it is necessary that the secondary seal be readily positionable to allow inspection of the primary seal without requiring extensive labor or causing damage to the secondary seal when it is necessary to inspect the primary seal.

Another problem associated with many prior art sealing systems which utilize primary and secondary seals is that the secondary seal must be attached to the primary seal and, therefore, does not allow for easy inspection. Furthermore, in the event the primary seal becomes distorted or loses its sealing capabilities, so does the secondary seal. Such seal attachment also requires that the seal be removed from the tank if the tank shell structure itself ever needs repair because the burning or welding on the tank structure would destroy the seals.

In certain prior art the seals are made of a fabric which is susceptible to puncture and tearing. The metallic-shoe, such as disclosed in U.S. Pat. No. 3,373,891 was designed in an attempt to eliminate this problem. However, complicated and complex linkage must be utilized to maintain a sufficient sealing force against the inner wall of the tank shell to prevent the roof from moving due to wind loads. If such linkage malfunctions the seal is broken. Another problem created by a metallic-shoe seal is due to the capillary action between the shoe and the inner wall of the tank shell. Since the shoe is immersed in the liquid contained within the storage tank, a capillary effect results in the liquid contained within the storage tank rising upwardly between the inner wall of the tank shell and the metallic-shoe. This capillary effect results in the liquid rising above the effective seal area.

SUMMARY OF THE INVENTION

It is, therefore, an object of this invention to improve sealing systems for liquid storage tanks of the type wherein the tank roof is freely floating on the liquid contained therein.

Another object of this invention is to improve liquid storage tank sealing systems of the type utilizing a primary and secondary seal.

A further object of this invention is to eliminate the capillary effect of the liquid contained in a liquid storage tank from rising between the inner walls of the storage tank and the seal due to capillary action.

Still another object of this invention is to facilitate inspection of the primary seal of a liquid storage tank sealing system utilizing primary and secondary seals by providing ready and convenient access to the seal.

Yet another object of this invention is to maintain a predetermined contact between a sealing system and the inner walls of a liquid storage tank to prevent contaminants from entering therein and vapors from escaping therefrom These and other objects are attained in accordance with the present invention wherein there is provided a sealing system for a liquid storage tank having a roof freely floating on the contents stored within the storage tank. The sealing system is in wiping contact with the tank shell and may utilize a primary and a secondary seal. As a primary seal, the system forms a seal above the liquid level and eliminates capillary action of the liquid between the seal and the tank shell. The sealing system also exerts a continuous pressure against the inner walls of the storage tank preventing the storage tank roof from shifting due to wind loading and effectively preventing vaporization of the liquid due to wind effected negative pressures. As a secondary seal, the system acts as a vapor barrier preventing vapors from escaping and preventing contaminants from entering into contact and deteriorating the primary seal which could result in contamination of the liquid contained within the storage tank.

DESCRIPTION OF THE DRAWINGS

Further objects of the invention together with additional features contributing thereto and advantages accruing therefrom will be apparent from the following description of the preferred embodiments of the invention which are shown in the accompanying drawings with like reference numerals indicating corresponding parts throughout.

DESCRIPTION OF THE PREFERRED EMBODIMENTS OF THE INVENTION

Figure 1:
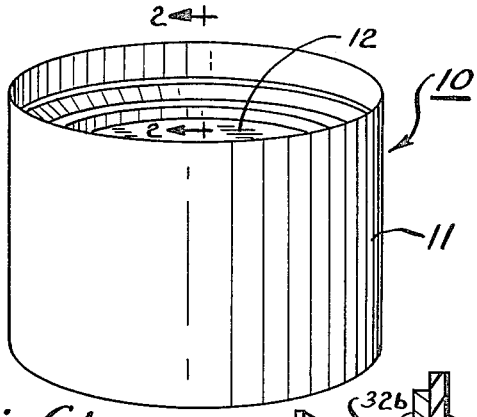
FIG. 1 is a frontal perspective view of a liquid storage tank utilizing an embodiment of the present invention.

Referring now to FIG. 1, there is illustrated a liquid storage tank 10 comprising a tank shell 11, joined to a suitable base to form a liquid tight container, and a roof 12 which is movable relative to the inner walls of the tank shell 11 to close the open upper end of the storage tank 10. The roof 12 is freely floating upon the liquid contained within the storage tank 10 in a manner known to those skilled in the art.

Figure 2:
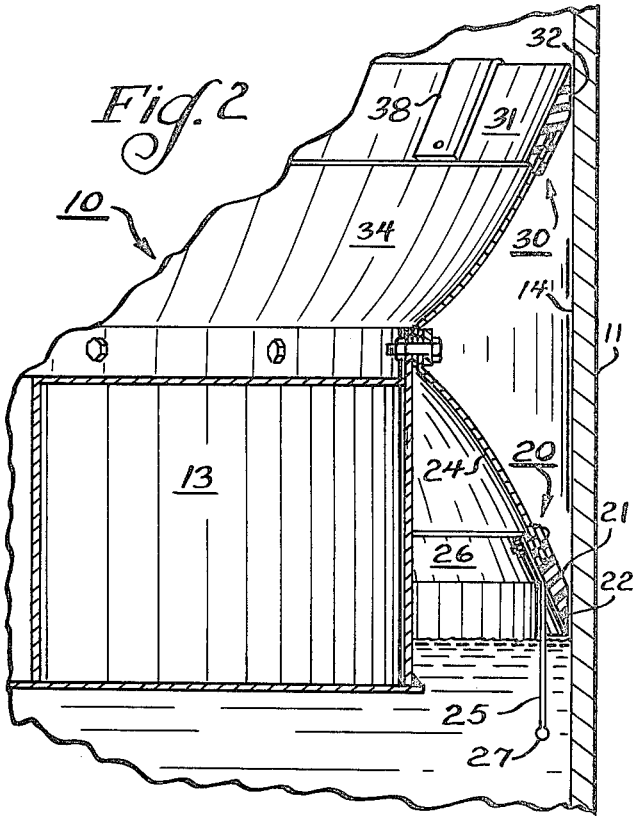
FIG. 2 is an enlarged cross sectional view of a portion of the storage tank shown in FIG. 1 to illustrate one embodiment of the invention.
Figure 4:
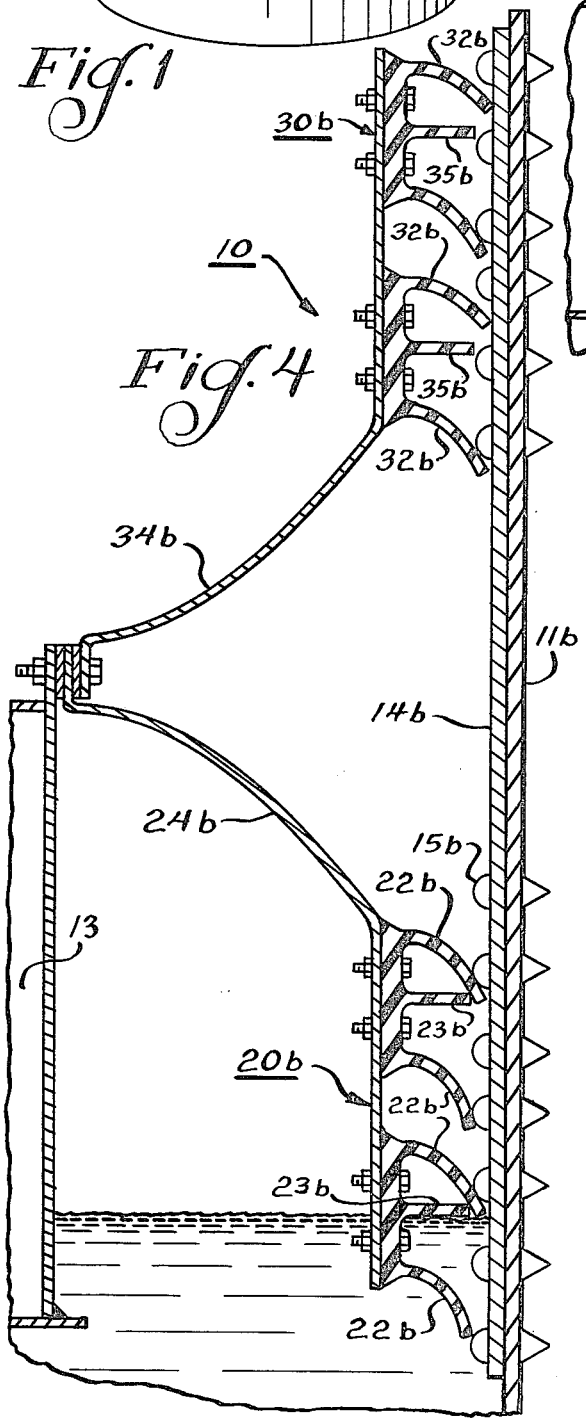
FIG. 4 is an enlarged cross sectional view of a portion of a liquid storage tank such as illustrated in FIG. 1 having a riveted construction to better illustrate a third embodiment of the invention.
Figure 3:
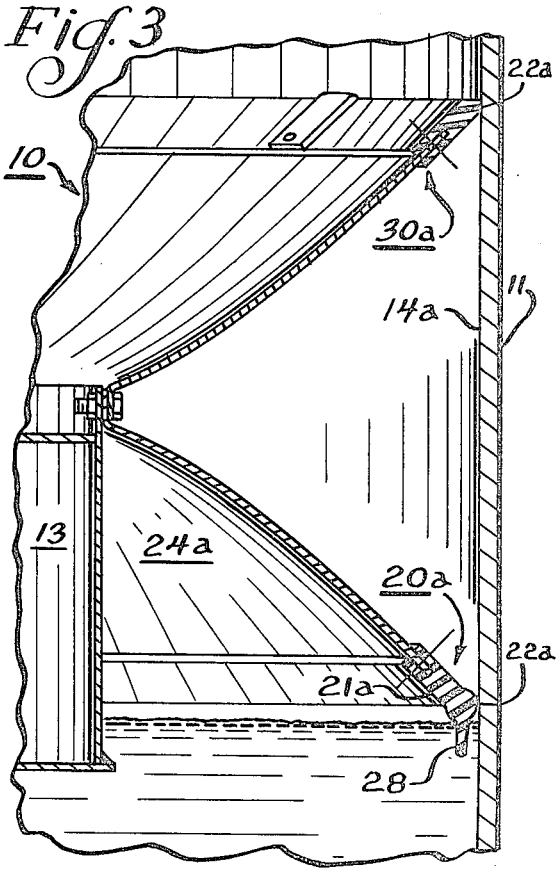
FIG. 3 is an enlarged cross sectional view of a portion of a liquid storage tank such as illustrated in FIG. 1 utilizing an alternative embodiment of the invention.

As previously discussed, in order to preserve the integrity of the liquid contained in the liquid storage tank 10 and to prevent vapors from escaping to the atmosphere a suitable sealing system must be provided. Three embodiments of the present invention are best shown in FIGS. 2, 3 and 4, utilizing a dual seal sealing system. The dual seal sealing system comprises a primary seal 20 and a secondary or auxiliary seal 30 supported from a pontoon 13 of the tank roof 12 to provide a suitable seal between the roof and an inner wall 14 of the liquid storage tank.

Referring first to the embodiment shown in FIG. 2, the primary seal 20 comprises a circumferentially extending, radially outwardly directed sealing portion 21 and a circumferentially extending, radially outwardly directed support plate member 24 which functions to provide a biasing force urging the sealing portion 21 into contact with the inner wall 14 of the tank shell 11. The sealing portion 21 is formed of an inert type material such as Buna-nitral and has a sealing face surface 22 positioned parallel to the inner wall 14 of the tank shell 11 to form a wiping seal between the radially inwardly directed inner wall surface 14 and the seal face 22.

The sealing portion 21 is connected to the support plate portion 24 by any suitable means which secures the seal portion to the support member. The support member 24 is connected at its other end to a portion of the float or pontoon 13 of the tank roof 12 in a manner to be explained in more detail with reference to FIGS. 5 and 6.

In order to minimize the escape of vapors from the storage tank 10, a urethane nylon skirt 25 extends circumferentially about the interior of the tank shell 11 and is spaced a predetermined distance from the inner wall 14. The skirt 25 is supported from the sealing portion 21 of the primary seal 20 by means of a backing plate 26 secured to the sealing portion 21 and the support member 24. The skirt 25 extends downwardly from the sealing portion 21 into the liquid and functions to prevent vapors from escaping from the storage tank by minimizing the area between the skirt 25 and the inner wall 14 of the tank shell 11.

In order to keep the skirt material straight, a weight 27 is hung from the lowermost portion of the skirt 25. The weight 27 is of an amount sufficient to keep the skirt material straight to prevent the skirt material from floating upon the liquid, but must not be greater than the force applied by the support member 24 which biases the sealing portion 21 against the internal wall 14 of the tank shell 11 which would destroy the sealing function of the sealing face 22 of the primary seal 20. In this manner, the skirt 25 functions to minimize the amount of liquid surface area from which vaporization may occur by limiting the exposed surface area to a radially outwardly directed circumferential ring extending between the skirt 25 and the inner surface 14 of the tank shell 11. By spacing the skirt 25 as close as possible to the inner wall 14 of the tank shell, the skirt in combination with the primary seal 20 will effectively eliminate losses due to liquid evaporization or vaporization.

The secondary seal 30 of the dual seal sealing system also comprises a sealing portion 31, constructed similar to the sealing portion 21, and a supporting portion 34, constructed similar to the supporting portion 24, from which the sealing portion 31 is supported. The other end of the supporting portion 34 is mounted to the pontoon or float 13 of the tank roof. The sealing portion 31 comprises a Buna-nitrile extrusion suitably fastened to one end of the supporting portion 34 and has a sealing face 32 which is parallel to the inner surface 14 of the tank shell 11 to form a seal therewith. The sealing portion 31 is biased into contact with the inner surface 14 of the tank shell 11 by means of the supporting section 34 which is secured to the pontoon 13 to bias the sealing portion 31 into contact with the inner surface 14 of the tank shell. Suitable grounding contacts 38, comprising stainless steel bands, are secured to the supporting portion 34 to contact the inner surface 14 of the tank shell to drain off and ground static electricity and lightning induced charges.

Referring now to the embodiment of the dual seal sealing system illustrated in FIG. 3, the dual seal sealing system comprises a primary seal **20*a* and a secondary seal 30*a*. The secondary seal 30*a* is the same as that illustrated with reference to FIG. 2, except that the end of the seal portion has been shaped such that the sealing face 22*a* is shorter and the end of the seal portion is truncated to form a surface normal to the inner walls 14*a***.

The primary seal **20*a* is supported from the pontoon 13 of the roof 12 in the manner previously described by a galvanized plate support portion 24*a*. The sealing portion 21*a* is formed of a Buna-nitral material but is of a different configuration than that shown in FIG. 2 in that the end portion or sealing face 22*a* contacting the inner wall 14 of the tank shell 11 is cylindrical in cross section and has a protuberance 28 extending radially outwardly from the cylindrical portion 22*a* and downwardly parallel to the inner wall 14 of the tank shell 11**.

The protuberance 28 functions in the manner of the skirt 25 in the embodiment disclosed in FIG. 2, by limiting the amount of exposed liquid surface area to limit evaporation to that surface area comprising a ring of a width defined between the inner surface 14 of the tank shell and the outer edge of the protuberance 28.

Referring now to the embodiment disclosed in FIG. 4, this embodiment is especially suitable and adapted for use with storage tanks having riveted tank shells. As shown, a primary seal 20*b* and a secondary seal 30*b* are supported from the pontoon 13 of the roof 12 and connected thereto in a manner to be described in more detail with reference to FIG. 5. Since the tank shell 11*b* is formed of riveted sections, the inner wall 14*b* is not smooth and, therefore, a continuous wiper type of seal as shown with reference to FIGS. 2 and 3 is not suitable for sealing purposes.

The embodiment of the present invention disclosed with reference to FIG. 4 includes the primary seal 20*b* and the secondary seal 30*b*. Both the primary and secondary seals comprise extrusions of a Buna-nitral material secured to a backing portion of the support member 24*b* and 34*b*, respectively, which extend parallel to the inner sidewalls 14*b*, and each have a plurality of outwardly extending flanges 22*b* and 32*b* which appear in cross section as fingers. The flanges 22*b* and 32*b* extend outwardly from a base portion a sufficient distance to contact and form a seal with the inner wall 14*b* of the tank shell 11*b* and are biased into sealing contact with the shell by the action of the support members 24*b* and 34*b*, respectively. Positioned between the outwardly extending flanges 22*b* and 32*b* are shorter flanges 23*b* and 35*b*, respectively, which extend outwardly from the base portion a distance sufficient to be adjacent to the outermost extension of rivet heads 15*b* which are utilized to join sections of the tank shell 11*b*. The shorter flanges 23*b* and 35*b* function as a stiffener or brace to prevent the adjacent sealing flanges 22*b* and 34*b* from bending down into contact with each other or too far so that they might lose their sealing function. As best shown with reference to the primary seal 20*b*, the shorter flange 23*b* functions to brace the sealing flange 22*b* as it moves over the rivet head 15*b* and, thereby, maintains the sealing integrity of the seal. The wiping action of the seals 20*b* and 30*b*, as well as the other embodiments disclosed, creates a sweegee action between the face of the wiper seals 22 and 32 and the inner surface 14 of the tank shell to remove any deposits that accumulate on the inner surface of the shell 11 as the liquid level changes.

Figure 5:
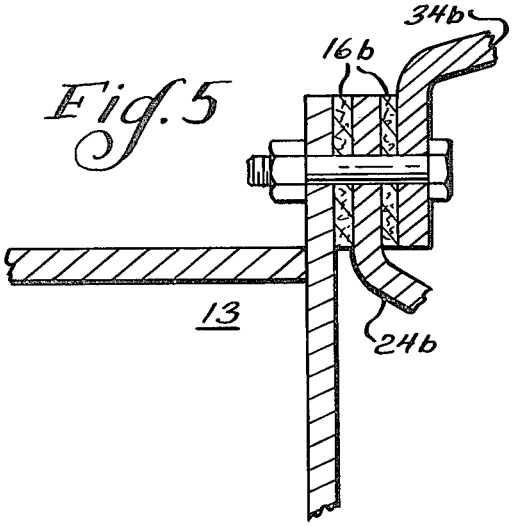
FIG. 5 is an enlarged view of a connnection between the dual seal sealing system and the roof of a storage tank.
Figure 6:
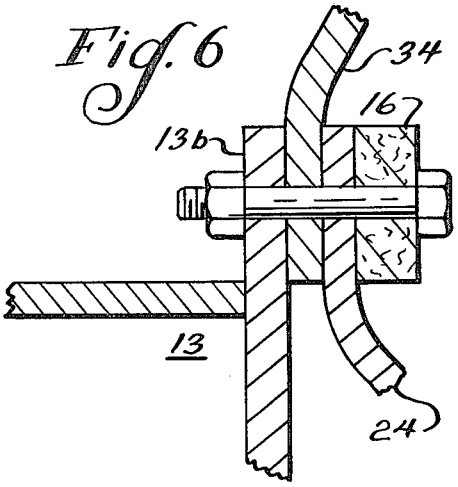
FIG. 6 is an enlarged view of an alternative manner of attaching the dual seal sealing system to the roof of a storage tank.

Referring now to FIGS. 5 and 6 there is shown various manners for connecting the dual seal sealing system to the float or pontoon 17 of the roof. Referring to FIG. 5, there is shown an enlargement of the connecting portion illustrated on a smaller scale with reference to FIG. 4. The supporting sections 24*b* and 34*b* are each connected to the float 13 as by means of a bolt passing through a flange portion 13*b* of the float and the end of the supporting members 24*b* and 34*b* opposite to that portion connected to the sealing members 21*b* and 31*b*. Suitable gasket material 16*b* is interposed between the two support sections 24*b* and 34*b* as well as between the support section 24*b* and the flange 13*b* of the float 13. In this manner the connection effectively seals the ends of the supporting members 24*b* and 34*b* to prevent rain, dust, snow, etc., from entering into the tank 10 and prevents vapors from escaping through the supporting connection.

Referring now to FIG. 6 there is shown an enlargement of the connection which is shown on a smaller scale with reference to the drawing of FIG. 2. The supporting portions 24 and 34 are joined together in adjacent contact and a suitable gasket material 16 is positioned adjacent the supporting member 24 which supports the primary seal 20 to effect a vapor and liquid tight connection with the float 13 of the roof. The supporting member 34 which is connected to the secondary seal 30 is positioned in adjacent contact with the flange 13*b* of the roof float 13 such that any rain, snow or ice will be directed by the supporting member inside the float and away from the connection to assist in preventing contaminants from entering into the container.

Figure 7:
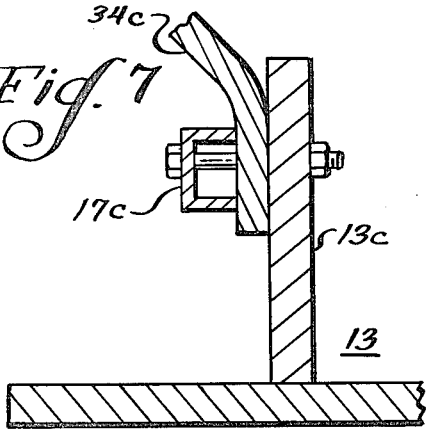
FIGS. 7, 8 and 9 are enlarged view of alternate connections of a single seal to the roof of a storage tank.
Figure 8:
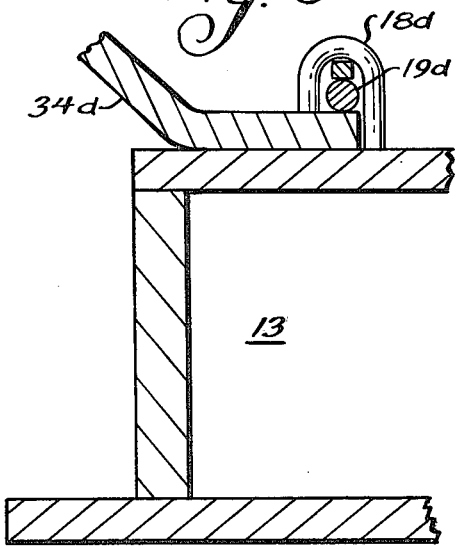
Figure 9:
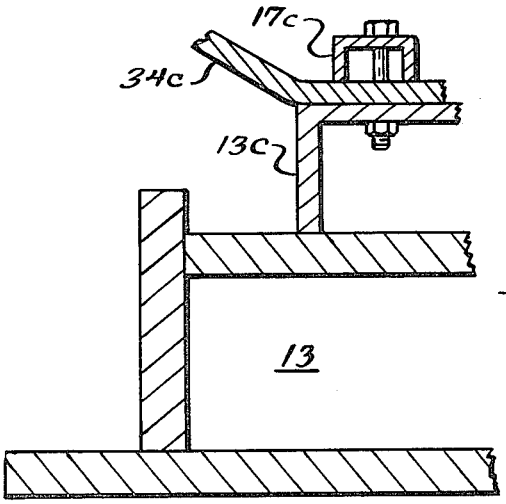

Referring to FIGS. 7, 8 and 9, there are illustrated various types of connections whereby a single sealing member may be attached to various types of floats 13 to better illustrate the manner in which the seal may be retrofitted to existing storage tanks which may have existing seals of various configuations. In FIG. 7, a supporting member 34*c* is shown connected to the rim plate 13*c* of a deck or roof float 13 of the storage tank by means of a rim clamp bar 17*c* suitably joined to the rim plate 13*c*. In this embodiment a seal 30 of the type illustrated in FIGS. 2, 3 and 4 may be readily retrofitted to an existing storage tank to function as either a primary or secondary seal without requiring welding or burning for installation while the tank is still in service.

As shown in FIG. 8, the seal structure 30 may be readily added to the deck or pontoon 13 of an existing storage tank with a rim plate having a portion 13*d* extending parallel with the pontoon or deck surface 13. A hook 18*d* is secured to the parallel portion 13*d* of the rim plate and by inserting a portion of the supporting structure 34*d* under the open end of the hook 18*d* and through the use of a cylindrical rod and a wedge 19*d*, the support member 34*d* may be secured to the rim plate 13*d* to function as a primary or secondary seal.

FIG. 9 illustrates the manner in which a supporting member may be attached to the deck or float 13 of a storage tank having another configuration of rim plate 13*e*. In this manner the supporting member 34*e* is bolted to a flange portion 13*e* of the rim plate by means of a rim clamp bar 17*e* and secured into position to function as either a primary or secondary seal.

In each of the installations illustrated in FIGS. 5 through 9 there is no welding or burning required for installation and, therefore, the seals can be installed on a storage tank 10 even when the tank is in service. By installing gasket material 16 between the sealing support member 34 and the connections to the roof, the seal structure 30 which has been referred to as a secondary seal in FIGS. 2, 3 and 4 can function as a primary seal. In addition, if a seal structure of the type disclosed as the secondary seals 30 in FIGS. 2, 3 and 4 is installed or retrofitted on an existing tank in the manner depicted by the connections of FIGS. 5 through 9, the secondary seal will eliminate water, snow, ice, dirt, etc., from accumulating on the existing tank seal thereby preventing any deterioration from these sources.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

what is claimed is:

1. A sealing system for use with a liquid storage tank having a roof freely floating on the contents stored within the tank comprising a circumferentially radially outwardly extending primary wiper seal means for engaging a radially inwardly directed inner wall of the liquid storage tank to form a substantially liquid tight seal therewith, supporting means adapted to be connected to the roof of the liquid storage tank and supporting said primary wiper seal means for applying a force thereto biasing said primary wiper seal means into sealing engagement with the inner wall of the liquid storage tank forming said wiping seal therewith at a position above the level of any liquid contained therein, said primary wiping seal means having two parallel sides each of which extend a length substantially exceeding its thickness and a sealing face having its entire sealing area formed to extend parallel to the inner walls of the liquid storage tank when in an unbiased condition without said biasing force applied thereto and inclined obliquely from at least one of said parallel sides for wiping said wall upon movement of the tank roof relative thereto, and vapor barrier means supported from said supporting means for inhibiting evaporation of the liquid contained within the liquid storage tank.

2. The apparatus of claim 1 wherein said vapor barrier means comprises a vapor impervious skirt depending downwardly from said primary wiping seal means into the liquid contained within the storage tank.

3. The apparatus of claim 1 wherein said primary wiping seal means is formed with an integral vapor barrier means comprising a protuberance depending downwardly into the liquid contained within the storage tank.

4. The apparatus of claim 1 wherein said primary wiping seal means comprises a chemically inert material having a substantially trapezoidal cross section.

5. The apparatus of claim 1 further including a circumferentially radially outwardly extending secondary wiping seal means for engaging a radially inwardly directed inner wall of the liquid storage tank to form a substantially liquid tight seal therewith, supporting means adapted to be connected to the roof of the liquid storage tank and supporting said secondary wiping seal means for applying a force thereto biasing said secondary wiping seal means into sealing engagement with the inner wall of the liquid storage tank forming said wiping seal therewith at a position above said primary wiping seal means, and said secondary wiping seal means having a length substantially exceeding its thickness and a sealing face portion formed to extend parallel to the inner walls of the liquid storage tank when in an unbiased condition without said biasing force applied thereto for wiping said wall upon movement of the tank roof relative thereto.

6. The apparatus of claim 5 further including electrical grounding means carried by said secondary wiping seal means in contact with the inner wall of the liquid storage tank to dissipate static electrical and lightning induced electrical charges.

7. The apparatus of claim 1 wherein said supporting means is secured to a flange portion of the roof deck by means of a substantially J-shaped bracket secured to the roof deck and wedge means for applying a force between said supporting means and said brackets.

8. The apparatus of claim 5 further including gasket forming means positioned between said supporting means to form a vapor barrier and substantially liquid tight seal.

9. The apparatus of claim 5 further including gasket forming means positioned between said supporting means and a portion of the tank roof to form a vapor barrier and substantially liquid tight seal.

10. The apparatus of claim 1 wherein said primary sealing means includes a plurality of sealing flanges extending outwardly from a common base into engagement with the tank walls.

11. The apparatus of claim 10 further including a bracing flange positioned between adjacent sealing flanges to limit flexural movement thereof.

* * * * *